US005174237A

United States Patent [19]

Beard

[11] Patent Number: 5,174,237

[45] Date of Patent: Dec. 29, 1992

[54] GRADE MARKER

[76] Inventor: Larry D. Beard, 19 Donner Creek, Clayton, Calif. 94517

[21] Appl. No.: 789,826

[22] Filed: Nov. 8, 1991

[51] Int. Cl.[5] ..... G09F 17/00

[52] U.S. Cl. ..... 116/209

[58] Field of Search ..... 116/209; 405/157; 40/612, 645

[56] References Cited

U.S. PATENT DOCUMENTS

| | | | |
|---|---|---|---|
| 2,506,197 | 5/1950 | Burger | 41/16.5 |
| 2,810,977 | 10/1957 | Barry | 41/10 |
| 3,162,880 | 12/1964 | Francis | 15/234 |
| 3,267,901 | 8/1966 | Carroll | 116/209 |
| 3,903,835 | 9/1975 | Carroll | 116/209 |
| 4,813,494 | 3/1989 | Beard et al. | 173/91 |
| 5,003,735 | 4/1991 | Bates | 116/209 X |
| 5,044,303 | 9/1991 | Culver, Jr. | 116/209 |

*Primary Examiner*—William A. Cuchlinski, Jr.
*Assistant Examiner*—W. Morris Worth
*Attorney, Agent, or Firm*—Robert T. Kloeppel

[57] ABSTRACT

A grade marker having a flag or feather made of a bundle of stiff, resilient strands, a wood peg, and at least one staple within which the feather is located. The feather is located within at least one staple. The staple is driven into the side of the peg or stake.

3 Claims, 1 Drawing Sheet

GRADE MARKER

BACKGROUND OF THE INVENTION

1. Field of the Invention

This invention relates to a an improved feather or indicator that is secured to the side of a wooden stake or peg by a means penetrating the side of the peg. The feather is used to help locate the peg or stake that in turn locates the grade of the soil surface or a point on a survey.

2. Discussion of the Prior Art

In the construction industry, staking is required for: (1) a topographic survey of the site to be used in the preparation of plans for a structure; (2) locating in the soil a system of stakes or other markers such as hubs, pegs or ginies, both in plan and in elevation from which the construction crew can take measurements of earthwork and other measurements for the proper construction of structures; (3) the giving of line and grade as needed to replace stakes distrubed by a construction; and (4) taking measurements necessary to determine the volume of work actually performed up to a given data as evidence of percentage of completion of work so as to support a contractor's payment. Additionally, temporary stakes or other markers are usually set at the corners of proposed structures, as an approximate guide for beginning the excavation.

When a stake is driven into the soil it may be driven by a hammer or with a stake driver, see U.S. Pat. No. 4,813,494 for the details of such a driver. Currently the location of the stake is found by the feather that is driven into the top of the peg or stake. There are two patents that claim this invention in different embodiments.

The first is U.S. Pat. No. 3,267,901. This patent discloses a grade stake feather made up of a bundle of strands of nylon filament. A staple is driven into the top of the stake to hold the bundle of strands in place.

The second is U.S. Pat. No. 3,903,835. This patent discloses a bundle of stiff, resilient strands attached to the top of a stake by means of metal hoop with a loop that contains the strands and which may be driven into the top of a stake or slipped over a nail.

My experience with the use of a feather fastened to the top of the peg or stake is that they pull out of the stake when installed as disclosed in the two mentioned U.S. Patents. I will described in more detail how feather pullout occurs in a typical construction process such as building a road. When a road is constructed excess gravel is brought to the road site and then watered and compacted with vibrating roller or other means to obtain the desired gravel compactness. Then a grader will cut the excess gravel and remove the cut gravel to another location. The operator of the grader determines the correct elevation of the road grade by cutting the gravel to the top of the stakes that have been previously driven or set to the correct grade. In the typical situation, the top of the stake is several inches below the top of the uncut gravel. When the top of the stake is so buried or hidden from sight, the operator of the grader finds the stake by the feather. I have observed that when the grader blade goes over the feather, the feather will bend over and be lodge between the grader blade and the top of the gravel causing a frictional force to develop between the feather and the blade. When the resulting force of the blade against the feather is greater than the friction developed between the parallel grain of the stake and the fastener that is driven into the top of the stake, the feather is pulled out. The feathers then have to be replaced if the stake can be found or worst a new stake must be driven or set. However, by securing my invention, i.e. securing the feather to the side of the wooden stake, the means for securing the feather, is driven perpendicular to the wood grain which results in much more withdrawal resistance of the fastener means. This reduces the number of lost feathers and in turn reduces the number of lost man hours and standby time to do a construction job because less stakes need to be replaced and related standby time for equipment and crew members who cannot work until the grade stakes are relocated is reduced.

Neither of the above mentioned patents recognize or suggest the advantage of driving the means for attaching the feather into side of the peg or stake so that the attaching means is perpendicular to the grain of the peg. The inventor of the patents actually teaches away from my invention when the inventor expressly limits the location of the means to attach the feather to the top of the peg.

The disadvantage of the prior art are basically eliminated by the use of my invention.

SUMMARY OF THE INVENTION

My invention comprises an indicator (also called a flag, or feather) made of a bundle of stiff, resilient strands, a wood peg, and at least one staple within which the feather is located. The staple with the feather located within it is driven into the side of the peg or stake. Throughout the specification including the claims, "peg" means a wooden stake or peg that is rounded or has flat sides with either a flat or rounded top. In other words the shape of the side or top of the peg is not required to be of any particular shape. The location of the feather is on the side of the peg instead on the top of the peg. The staple may be driven into the side by a hammer or staple gun.

DESCRIPTION OF THE PREFERRED EMBODIMENT

Figure 1:
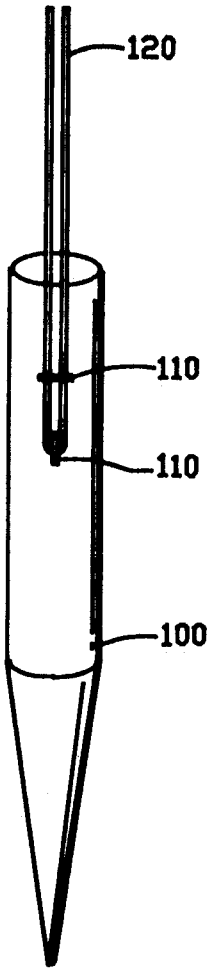
FIG. 1 illustrates the peg with two staples securing the feather to the peg.

My invention is illustrated in FIG. 1. The feather 120 maybe made from a bundle or plurality of stiff, resilient strands. The feather may be nylon or other material that stands erectly above the top of the stake when secured in the manner I describe. The feather can be red, blue or yellow or other color that will stand out and be seen by construction crews during grading, excavating or surveying. The peg with the feather secured to the side of the peg is referred in the claims as a grade marker. The feather is secured to the side of the peg or stake 100 with at least one staple 110 so that the staples are perpendicular to the grain of the peg to increase the withdrawal resistance of the staple. When more than one staple is used they are inserted into the side of the peg perpendicular to each other, FIG. 2. Whether one or more staples are used, the staples are inserted a distance from the top of the peg as illustrated in the drawings. As previously mentioned, throughout the specification including the claims, "peg" means a stake or wooden peg that is rounded or has flat sides with either a flat or rounded top and usually has a pointed bottom. In other words the shape of the side or top of the peg is not required to be any particular shape.

Figure 3:
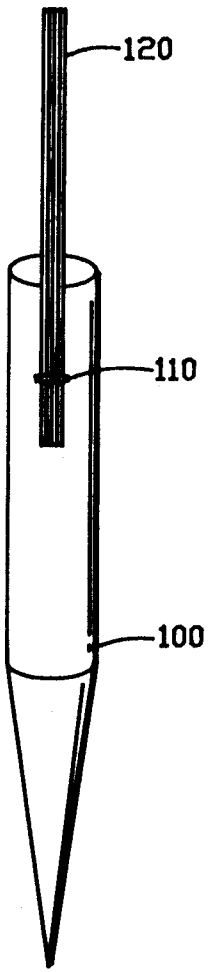
FIG. 3 illustrates the peg with the feather unbent and secured with one staple.
Figure 2:
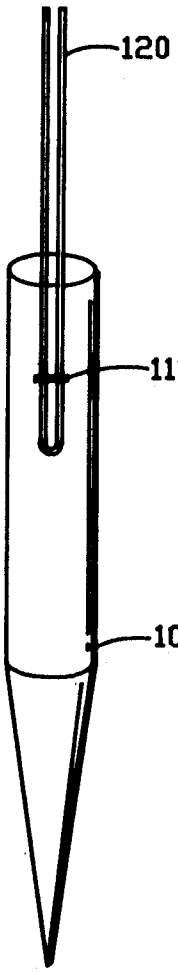
FIG. 2 illustrates the peg with one staple securing the feather to the peg.

FIG. 1 shows the feather attached to the side of the stake with two staples while FIG. 2 illustrates the feather secured to the side of the stake with just one staple. The feather's strands can be bent in a u-shape prior to securing it to the peg. If sufficient strands make up the feather, the feather may be secured by only one staple whose bight circumscribes the strands, FIG. 3. On the other hand, if more strength is required, the feather is bent in a u-shape and secured with at least one staple whose bight circumscribes the bent portion of the feather and another staple above and at approximately 90 degrees to the other staple whose bight also circumscribes the feather. These staples keep the feather standing erectly above the top of the stake.

The staple is a means for securing the feather to the peg though other such means known to those skilled in the art may be substituted for the staple. With the feather secured in this manner, the feather can maintain its erect position so that it can be spotted easily by construction crews.

Figure 4:
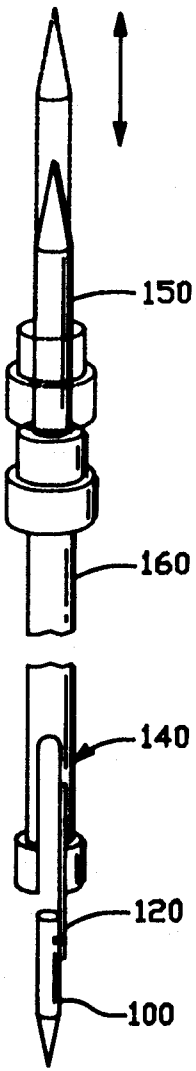
FIG. 4 illustrates the stake driver with the peg located in it and the feather in the slot. The feather is fixed to the stake by one staple.

FIG. 4 illustrates the peg with a feather 120 secured to the side of the peg inserted into the open end of the stake driver 140. The stake driver is made up of a first rod 160 and a second rod 150. The first rod is inserted into the second rod and the peg 100 is located at the lower end of the first rod of the stake drive so that the top of the peg is located adjacent to the bottom of the rod 150. By lifting the rod 150 and letting it fall, the peg is driven into the soil.

As mentioned the feather is secured to the side of the peg, the staple is perpendicular to the grain of the wooden peg resulting in the feather being better secured to the peg because of the increased withdrawal resistance of the grain of the peg perpendicular to the staple in contrast to a feather held in place by a staple or other means of attachment driven into the top of the peg parallel to its grain which occurs when the feather is attached to the top of the peg. Further my invention eliminates the need to have the top of the peg be flat since my invention does not require the top of the peg to accommodate the means for attaching the feather to the peg.

The foregoing description and drawings of the preferred embodiment will suggest other embodiments and variations with the scope of the claims to those skilled in the art, all of which are intended to be included in the spirit of the invention as herein set forth.

What I claim is;

1. A grade marker comprising: a wooden peg that can be driven into the soil, the wooden peg having a top and side, a plurality of stiff, resilient strands attachable to the side of the wooden peg, the strands extending above the top substantially erectly from and parallel to the side of the wooden peg so that the grade marker can be seen by construction crews when the peg has been driven into the soil, and means for securing the strands to the side of the wooden peg, said means penetrating into the side of the wooden peg.

2. A grade marker comprising: a wooden stake that can be driven into the soil, the wooden stake having a top and sides, a bundle of resilient strands which are folded in substantially a u-shape, at least one means for securing the folded end of the resilient strands to the side of the wooden stake so that the strands extend substantially erectly from and parallel to the side of the wooden stake and above the top of the wooden stake, said means penetrating into the side of the wooden stake.

3. A grade marker comprising: a wooden stake that can be driven into soil, the wooden stake having at least one side and a pointed bottom end that is driven into the soil and a top, a feather, wherein the feather includes a plurality of strands of resilient material bent to form a substantially u-shaped portion at one end and wherein the feather is capable of standing substantially erectly and parallel to the stake when so bent and secured to said at least one side of the stake, a plurality of staples, wherein each staple has a bight, the bight of at least one of the staples circumscribing the bent portion of the feather when said circumscribing staples is driven into said at least one side of the wooden stake, and the bight of at least another of the staples covering said strands and located above and at approximately 90 degrees to said circumscribing staple when said covering staple is driven into said at least one side of the stake so that the staples keep the feather standing erectly above the top of the stake.

* * * * *